US006681460B2

(12) United States Patent
Liu

(10) Patent No.: US 6,681,460 B2
(45) Date of Patent: Jan. 27, 2004

(54) DOUBLE-BOW SHOE LACE DEVICE

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 10/115,969

(22) Filed: Apr. 5, 2002

(65) Prior Publication Data

US 2003/0188404 A1 Oct. 9, 2003

(51) Int. Cl.[7] ..... A43C 7/00
(52) U.S. Cl. ..... 24/712.5; 24/115 G; 24/712.1
(58) Field of Search ..... 24/712.5, 115 G, 24/300, 712.1–712.4, 712.6–712.9; 36/50.1

(56) References Cited

U.S. PATENT DOCUMENTS 2,869,204 A * 1/1959 Mopps ..... 24/712.8
4,112,551 A * 9/1978 Sales ..... 24/712.5
4,393,550 A * 7/1983 Yang et al. ..... 24/712.5
5,293,675 A * 3/1994 Shai ..... 24/712.1
5,335,400 A * 8/1994 Sales ..... 24/712.5
6,178,606 B1 * 1/2001 Glendon ..... 24/712.5
6,334,240 B1 * 1/2002 Li ..... 24/115 G
6,453,524 B1 * 9/2002 Liu ..... 24/712.5
6,453,525 B1 * 9/2002 Liu ..... 24/712.5

FOREIGN PATENT DOCUMENTS

GB 2066891 A * 7/1981

* cited by examiner

*Primary Examiner*—Anthony Knight
*Assistant Examiner*—André L. Jackson
(74) *Attorney, Agent, or Firm*—Foley & Lardner

(57) ABSTRACT

A double-bow shoe lace device includes a shoe lace having first and second lace segments, two loop assemblies, and a clamp member sleeved slidably on the loop assemblies. The first lace segment forms a criss-cross pattern on the eyelet tabs. The second lace segment includes first and second lace sections, each of which has a lower end connected to the first lace segment. Each of the loop assemblies includes a distal lace segment, an inverted U-shaped lace segment having first and second ends connected respectively to the distal lace segment and the upper end of a respective one of the first and second lace sections, and a fastening unit for fastening together the distal lace segment and the ends of the inverted U-shaped lace segment.

8 Claims, 12 Drawing Sheets

DOUBLE-BOW SHOE LACE DEVICE

BACKGROUND OF THE INVENTION

1. Field of the Invention

The invention relates to a shoe lace device, more particularly to a double-bow shoe lace device for a shoe.

2. Description of the Related Art

Referring to FIGS. 1 and 2, in co-pending U.S. patent application Ser. No. 09/920,946, filed by the applicant on Aug. 8, 2001, there is disclosed a double-bow shoe lace device 1 of a shoe 5 that includes a shoe lace 4 having first and second lace segments 41, 42, a clamp member 2, and an assembly 3 of two loops 302 and a decorative knot 301. The first lace segment 41 is strung on a shoe body 501 so as to form a criss-cross pattern on eyelet tabs 504 of the shoe body 501. The second lace segment 42 includes first and second lace sections 421, 422. The lace sections 421, 422 have lower ends 4211, 4221 connected to the first lace segment 201 so as to be anchored respectively on the eyelets 503 of the eyelet tabs 504, and upper ends 4212, 4222 extending through the clamp member 2. The clamp member 2 includes an elongate casing 201, a clamping block 202 slidably received in the casing 201, and a biasing member 203 disposed between the clamping block 202 and the casing 201. The decorative knot 301 of the assembly 3 is disposed on top of the casing 201. Each of the loops 302 extends out of the casing 201 to connect with the knot 301. The assembly 3 is thus secured on the clamp member 2. The upper ends 4212, 4222 of the lace sections 421, 422 form distal lace segments 4214, 4224 which cooperate with the assembly 3 to form a double-bow configuration.

In use, by pulling apart the distal lace segments 4214, 4224, the clamp member 2 will be forced to slide downwardly along the lace sections 421, 422, thereby bringing the lower ends 4211, 4221 of the lace sections closer together for tightening the shoe 5. To loosen the shoe 5, the clamping block 202 is operated to compress the biasing member 203, and the clamp member 2 is moved upwardly along the lace sections 421, 422, there by moving the lower ends 4211, 4221 of the lace sections 421, 422 away from each other for loosening the shoe 5.

Although the aforesaid double-bow shoe lace device 1 can achieve its intended purpose, there is a need to provide a double-bow shoe lace device with a more simple and reliable structure.

SUMMARY OF THE INVENTION

Therefore, the main object of the present invention is to provide a double-bow shoe lace device of the aforesaid type with a more simple and reliable structure.

According to one aspect of this invention, a double-bow shoe lace device for a shoe with a pair of eyelet tabs comprises a shoe lace, two loop assemblies, and a clamp member. The shoe lace has first and second lace segments. The first lace segment is adapted to be strung on the shoe so as to form a criss-cross pattern on the eyelet tabs. The second lace segment includes first and second lace sections, each of which has a lower end connected to the first lace segment so as to be adapted to be anchored on a respective one of the eyelet tabs, and an upper end. Each of the loop assemblies includes a distal lace segment, an inverted U-shaped lace segment, and a fastening unit. The inverted U-shaped lace segment has a first end connected to the distal lace segment, and a second end connected to the upper end of a respective one of the first and second lace sections. The fastening unit fastens together the distal lace segment and the first and second ends of the inverted U-shaped lace segment. The clamp member is sleeved slidably on the loop assemblies. Downward movement of the clamp member along the loop assemblies brings the lower ends of the first and second lace portions closer together for tightening the shoe. Upward movement of the clamp member along the loop assemblies permits the lower ends of the first and second lace portions to move away from each other for loosening the shoe.

According to another aspect of this invention, a double-bow shoe lace device for a shoe with a pair of eyelet tabs comprises a shoe lace, a first loop assembly, a second loop assembly, and a clamp member. The shoe lace has first and second lace segments. The first lace segment is adapted to be strung on the shoe so as to form a criss-cross pattern on the eyelet tabs. The second lace segment includes first and second lace sections. Each of the first and second lace sections has a lower end connected to the first lace segment so as to be adapted to be anchored on a respective one of the eyelet tabs, and an upper end. The first loop assembly includes a first distal lace segment, a first inverted U-shaped lace segment having a first end connected to the first distal lace segment, and a second end connected to the upper end of the first lace section, and a fastening unit for fastening together the first distal lace segment and the first and second ends of the first inverted U-shaped lace segment. The second loop assembly includes a second distal lace segment, a second inverted U-shaped lace segment having first and second ends, and a decorative knot connected to the second distal lace segment, the first and second ends of the second inverted U-shaped lace segment, and the upper end of the second lace section. The clamp member is sleeved slidably on the first loop assembly, and permits the upper end of the second lace section to extend therethrough. Downward movement of the clamp member along the first loop assembly brings the lower ends of the first and second lace sections closer together for tightening the shoe. Upward movement of the clamp member along the first loop assembly permits the lower ends of the first and second lace sections to move away from each other for loosening the shoe.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
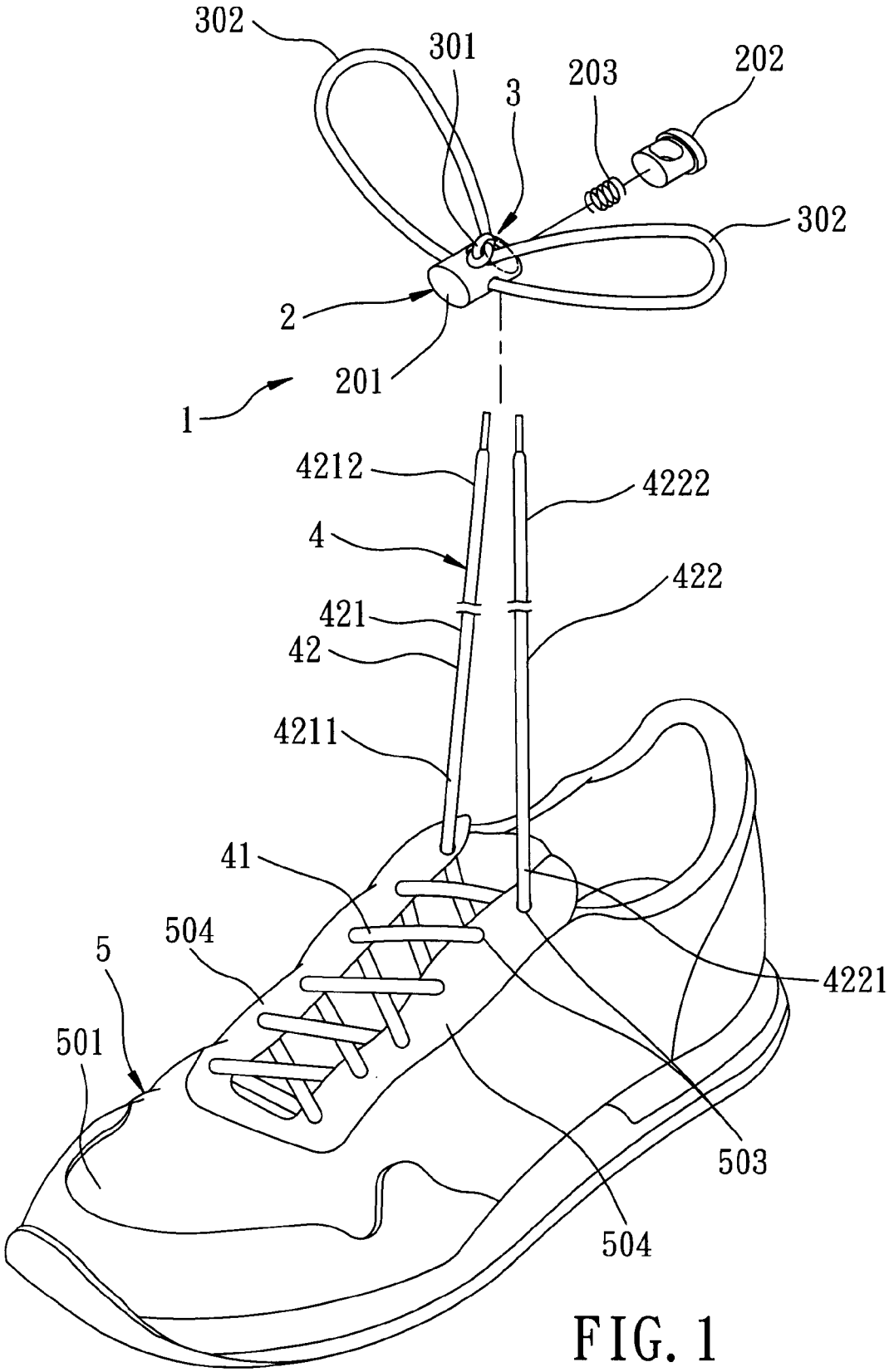
FIG. 1 PRIOR ART
FIG. 1 is a perspective view of a shoe that incorporates a double-bow shoe lace device according to co-pending U.S. patent application Ser. No. 09/920,946 by the applicant.
Figure 2:
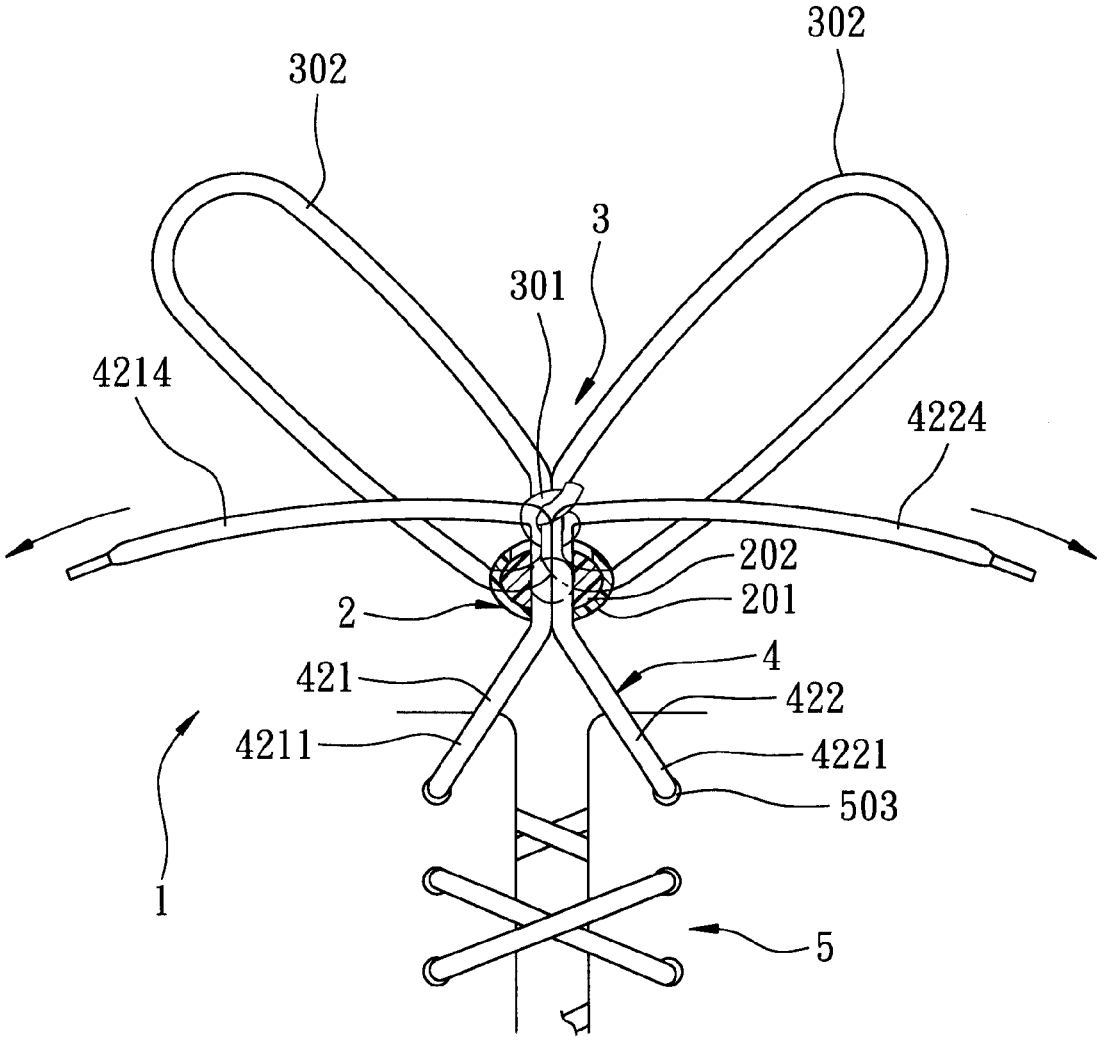
FIG. 2 PRIOR ART
FIG. 2 is a fragmentary cross-sectional view illustrating how the shoe of FIG. 1 is tightened by pulling apart first and second lace sections of a shoe lace.
Figure 3:
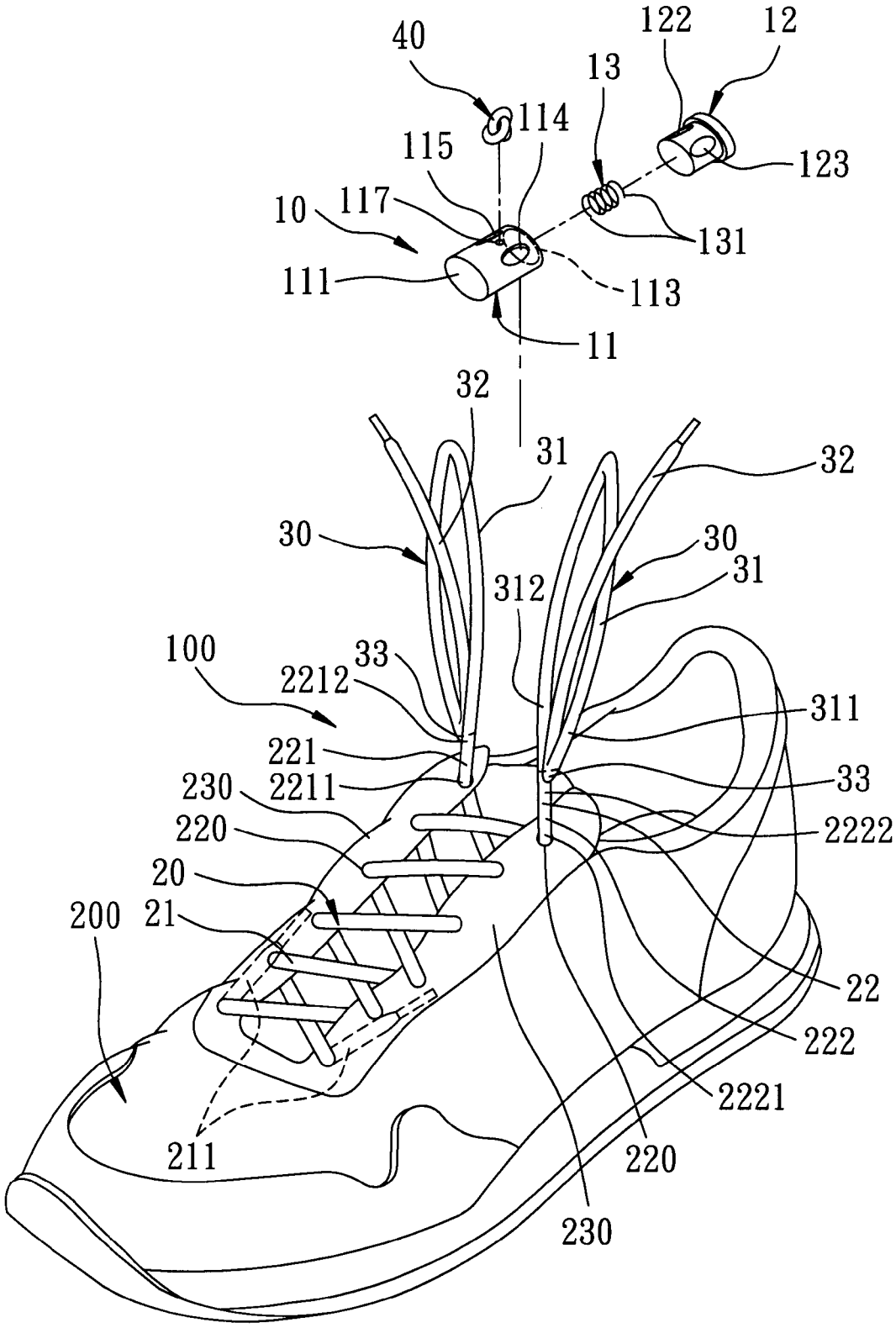
FIG. 3 is a perspective view of a shoe that incorporates the first preferred embodiment of a double-bow shoe lace device according to the present invention.

Before the present invention is described in greater detail, it should be noted that like elements are denoted by the same reference numerals throughout the disclosure.

Referring to FIGS. 3 to 8, the first preferred embodiment of a double-bow shoe lace device 100 according to the present invention is shown to be adapted for use with a shoe 200 having a pair of eyelet tabs 230. The shoe lace device 100 comprises a shoe lace 20, two loop assemblies 30, a clamp member 10, and a decorative knot 40. The shoe lace 20 has first and second lace segments 21, 22. In this embodiment, the first lace segment 21 is adapted to be strung on eyelets 220 of the shoe 200 so as to form a crisscross pattern on the eyelet tabs 230, and has distal ends 211 concealed by the eyelet tabs 230. The second lace segment 22 includes first and second lace sections 221, 222, each of which has a lower end 2211, 2221 connected to the first lace segment 21 so as to be adapted to be anchored on a respective one of the eyelet tabs 230, and an upper end 2212, 2222.

In this embodiment, each of the loop assemblies 30 is integrally and respectively connected to the upper ends 2212, 2222 of the first and second lace sections 221, 222, and includes a distal lace segment 32, an inverted U-shaped lace segment 31, and a fastening unit 33. The inverted U-shaped lace segment 31 has a first end 311 connected to the distal lace segment 32, and a second end 312 connected to the upper end 2212, 2222 of the respective one of the first and second lace sections 221, 222. The fastening unit 33 is in the form of a thread that sews together the distal lace segment 32 and the first and second ends 311, 312 of the inverted U-shaped lace segment 31, so as to result in a dimension that is three times the cross-section area of the shoe lace 20.

The clamp member 10 is sleeved slidably on the loop assemblies 30, and includes an elongate casing 11, a clamping block 12, and a biasing member 13. The elongate casing 11 has an open lateral side 113 and a closed end portion 111 opposite to the open lateral side 113, and is formed with first and second loop holes 115, 114 for extension of the loop assemblies 30 respectively therethrough, and a slot 117 between the loop holes 115, 114. The clamping block 12 is slidably received in the open lateral side 113 of the casing 11, and is formed with first and second loop slots 122, 123 that correspond to the first and second loopholes 115, 114 in the casing 11 for extension of the loop assemblies 30 respectively therethrough. The biasing member 13, in the form of a coil spring, is disposed in the casing 11, and has opposite ends 131 that abut respectively against the clamping block 12 and the closed end portion 111 of the casing 11. The biasing member 13 biases the clamping block 12 toward the open lateral side 113 of the casing 11, thereby clamping the loop assemblies 30 between the clamping block 12 and the casing 11.

Figure 4:
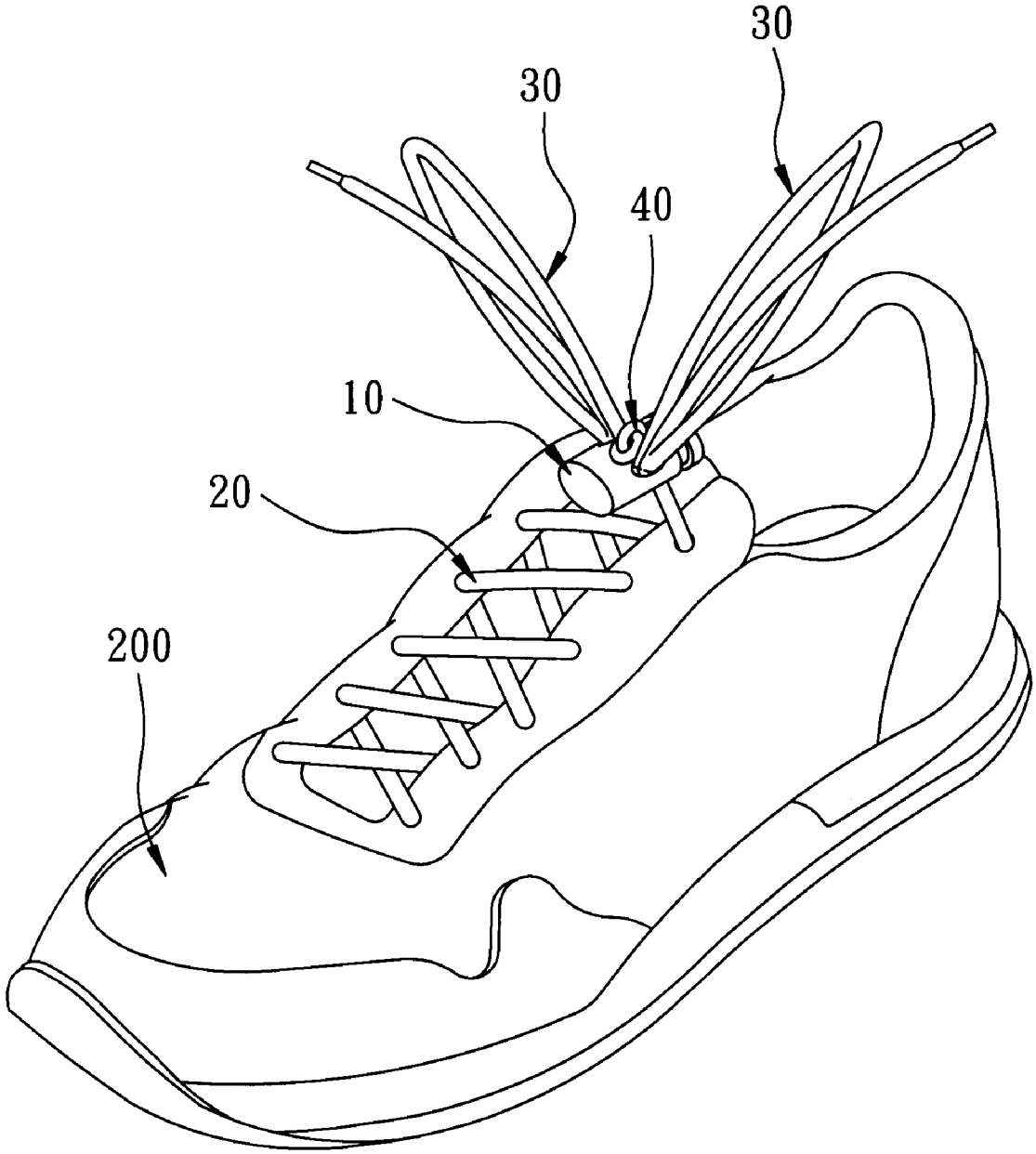
FIG. 4 is a perspective view showing the shoe with the first preferred embodiment in a tightened state.
Figure 5:
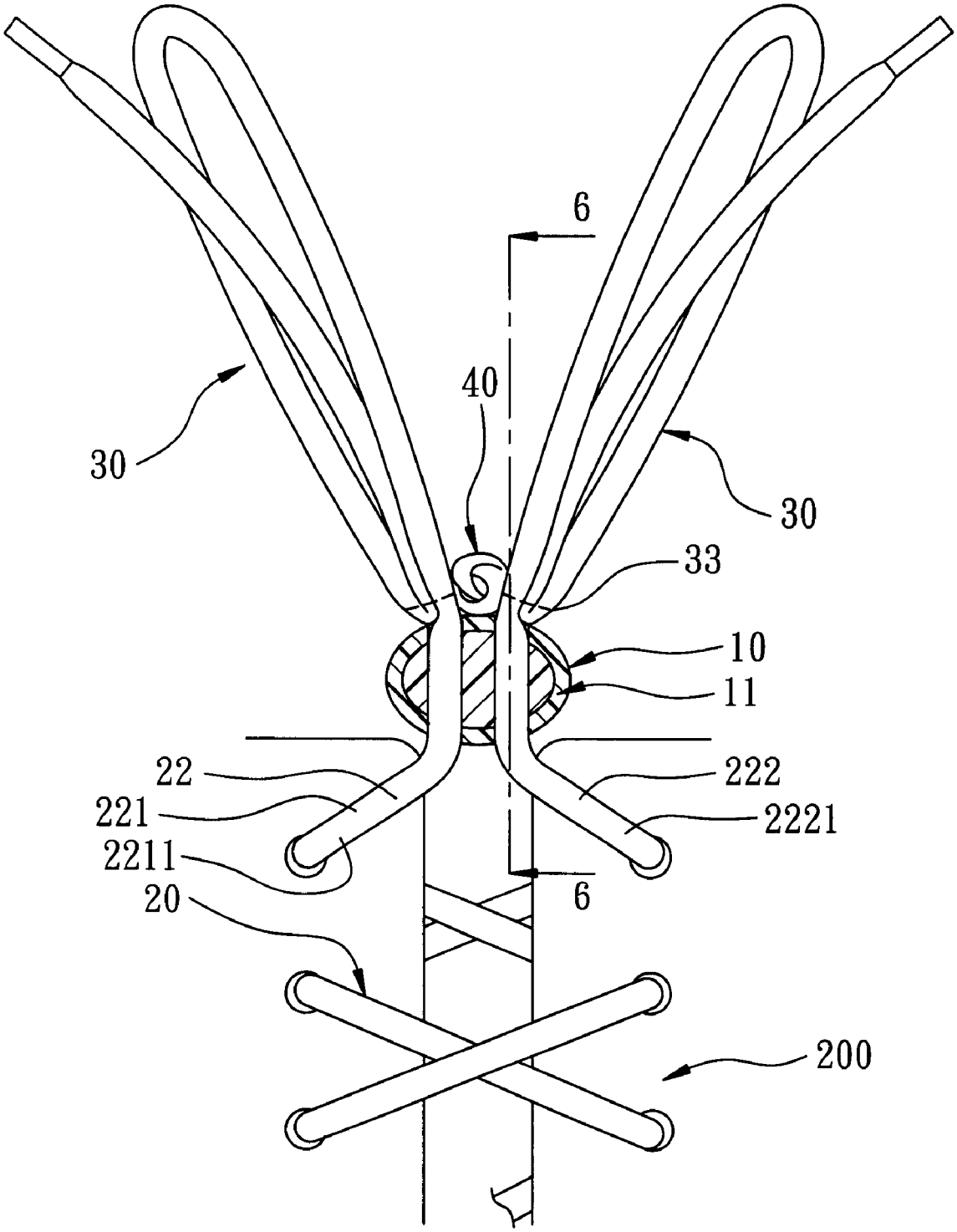
FIG. 5 is a fragmentary cross-sectional view illustrating how the shoe is tightened by pulling apart loop assemblies of the first preferred embodiment.
Figure 8:
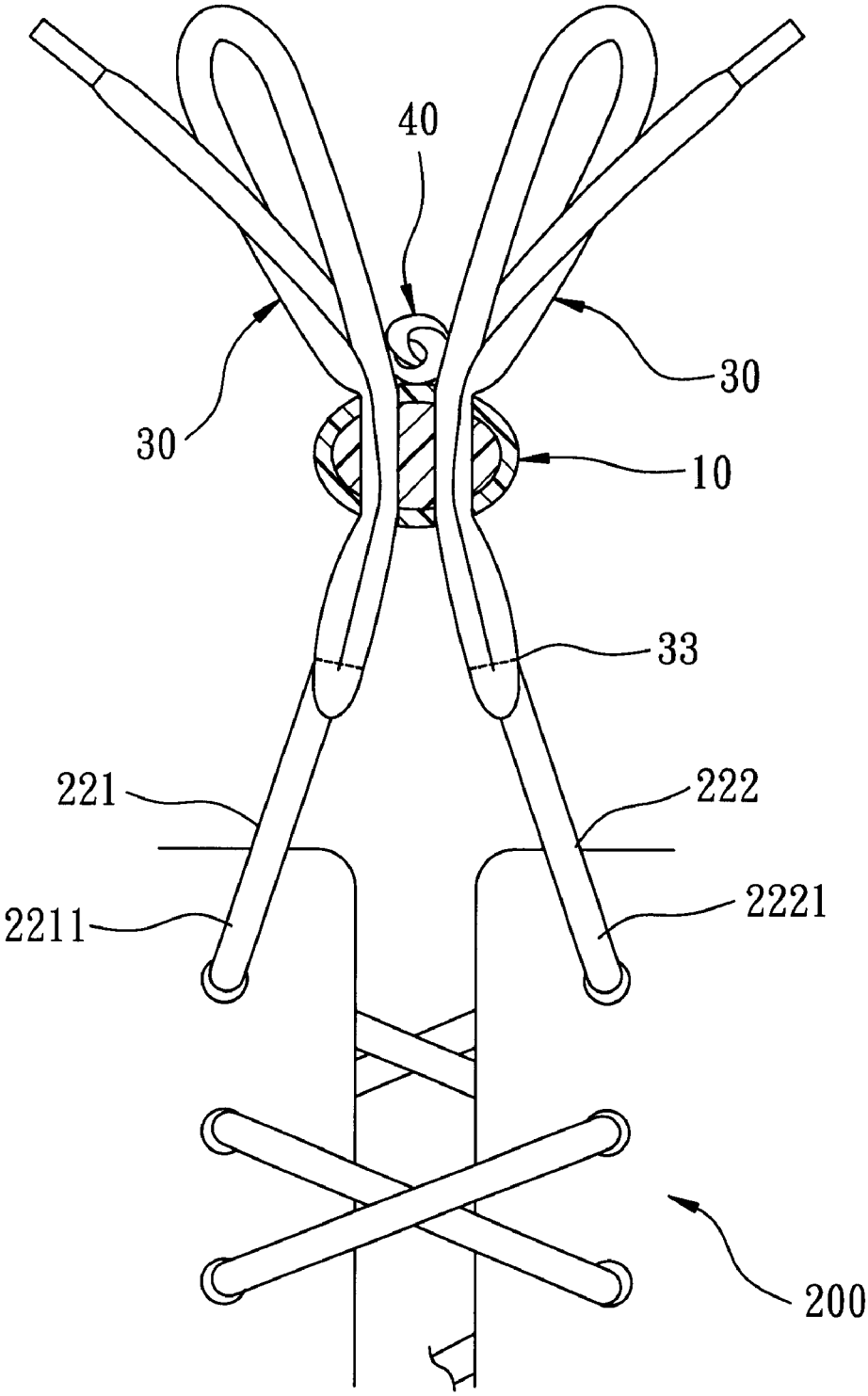
FIG. 8 illustrates how movement of the clamp member along the loop assemblies permits loosening of the shoe.

Downward movement of the clamp member 10 along the loop assemblies 30 brings the lower ends 2211, 2221 of the first and second lace portions 221, 222 closer together for tightening the shoe 200, as best shown in FIGS. 4 and 5. Upward movement of the clamp member 10 along the loop assemblies 30 permits the lower ends 2211, 2221 of the first and second lace portions 221, 222 to move away from each other for loosening the shoe 200, as best illustrated in FIG. 8.

The decorative knot 40 is sewn securely on the slot 117 in the casing 11 of the clamp member 10, and is disposed between the loop assemblies 30, as best illustrated in FIG. 4. The decorative knot 40 cooperates with the loop assemblies 30 to form a double-bow configuration.

Figure 6:
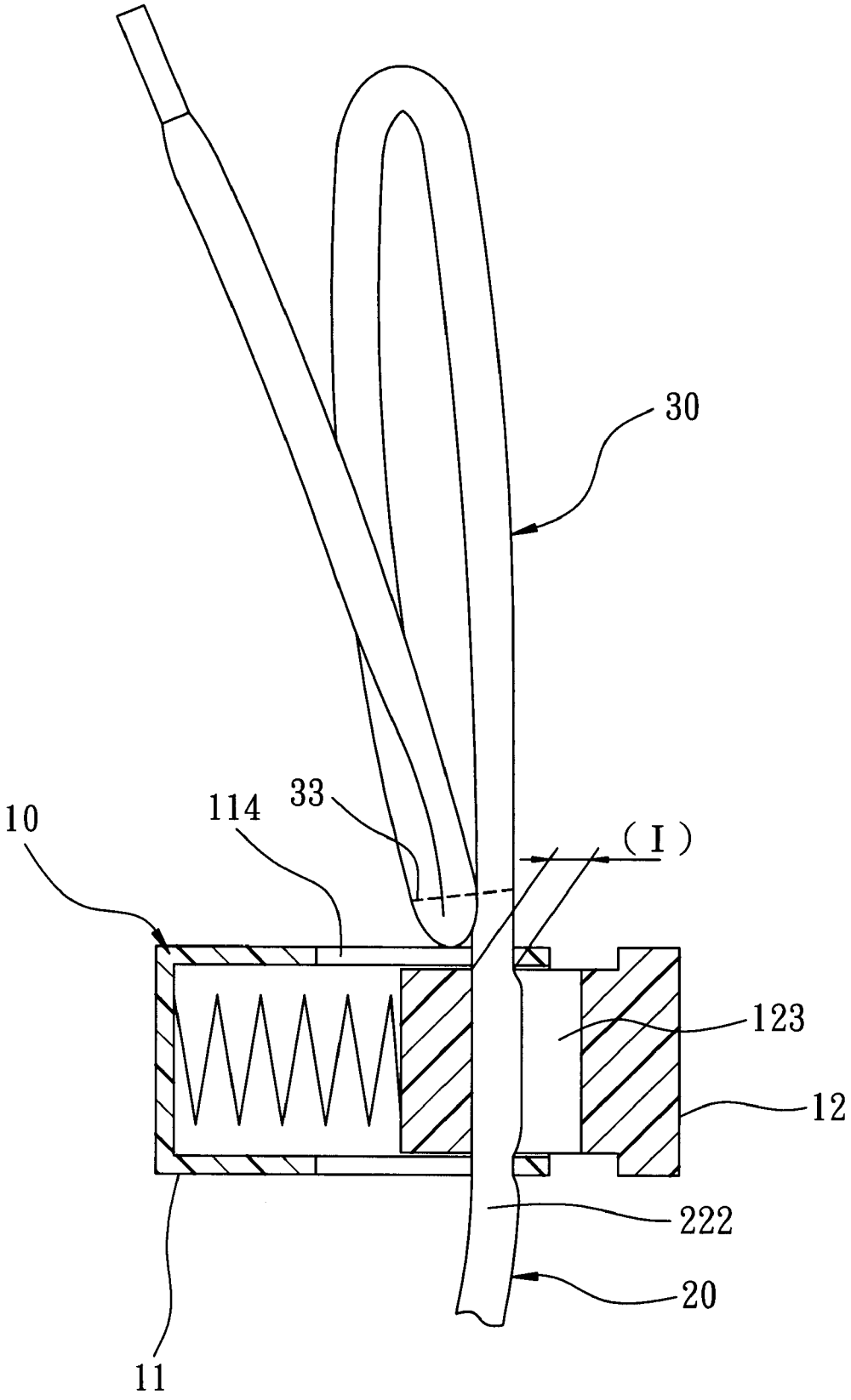
FIG. 6 is a sectional view of the first preferred embodiment taken along line 6—6 of FIG. 5.
Figure 7:
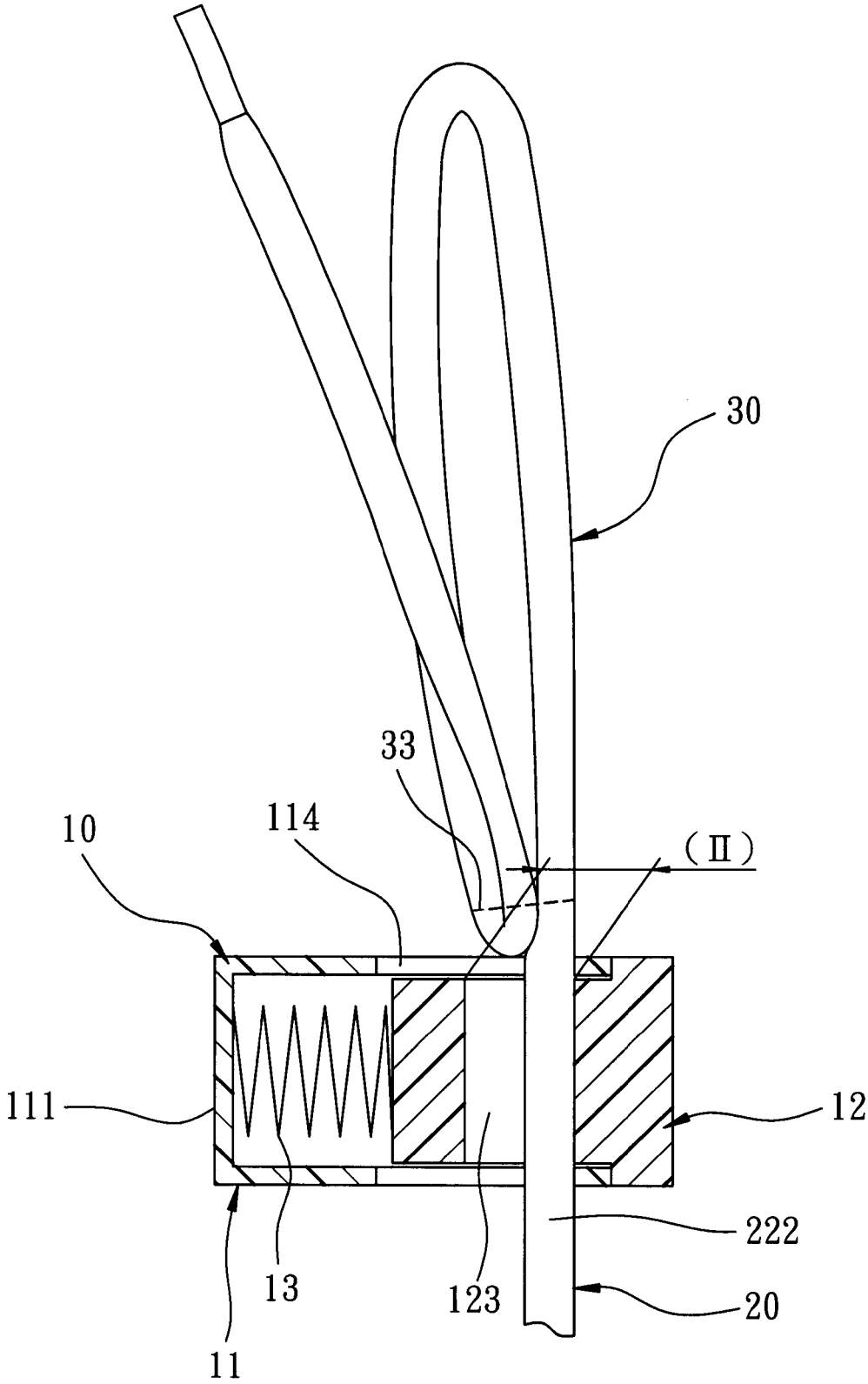
FIG. 7 illustrates how a clamping block of a clamp member of the first preferred embodiment is operated for releasing the loop assemblies from a clamped state.

Referring to FIG. 6, under normal circumstances, the loop slots 122, 123 (only one is visible) in the clamping block 12 are misaligned with the loop holes 115, 114 (only one is visible) in the casing 11, thereby forming a first clamp area (I). When the clamping block 12 is operated to compress the biasing member 13, as shown in FIG. 7, the loop slots 122, 123 (only one is visible) are aligned with the loop holes 115, 114 (only one is visible), thereby forming a second clamp area (II), which is larger than the first clamp area (I). Since the dimension at the fastening unit 33 is larger than the first clamp area (I), but is equal to or smaller than the second clamp area (II), the fastening unit 33 can extend through the clamp member 10 at this time.

In use, after the clamp member 10 is sleeved on the loop assemblies 30, the loop assemblies 30 are pulled apart from each other so that the clamp member 10 will be forced to slide downwardly along the loop assemblies 30, thereby bringing the lower ends 2211, 2221 of the lace sections 221, 222 closer together for tightening the shoe 200 (see FIG. 5). To loosen the shoe 200, the clamping block 12 is operated to compress the biasing member 13, thereby aligning the loop holes 115, 114 with the loop slots 122, 123 (see FIG. 7). At this time, by moving the clamp member 10 upwardly along the loop assemblies 30, the lower ends 2211, 2221 of the lace sections 221, 222 can be moved away from each other, thereby loosening the shoe 200 (see FIG. 8).

Figure 9:
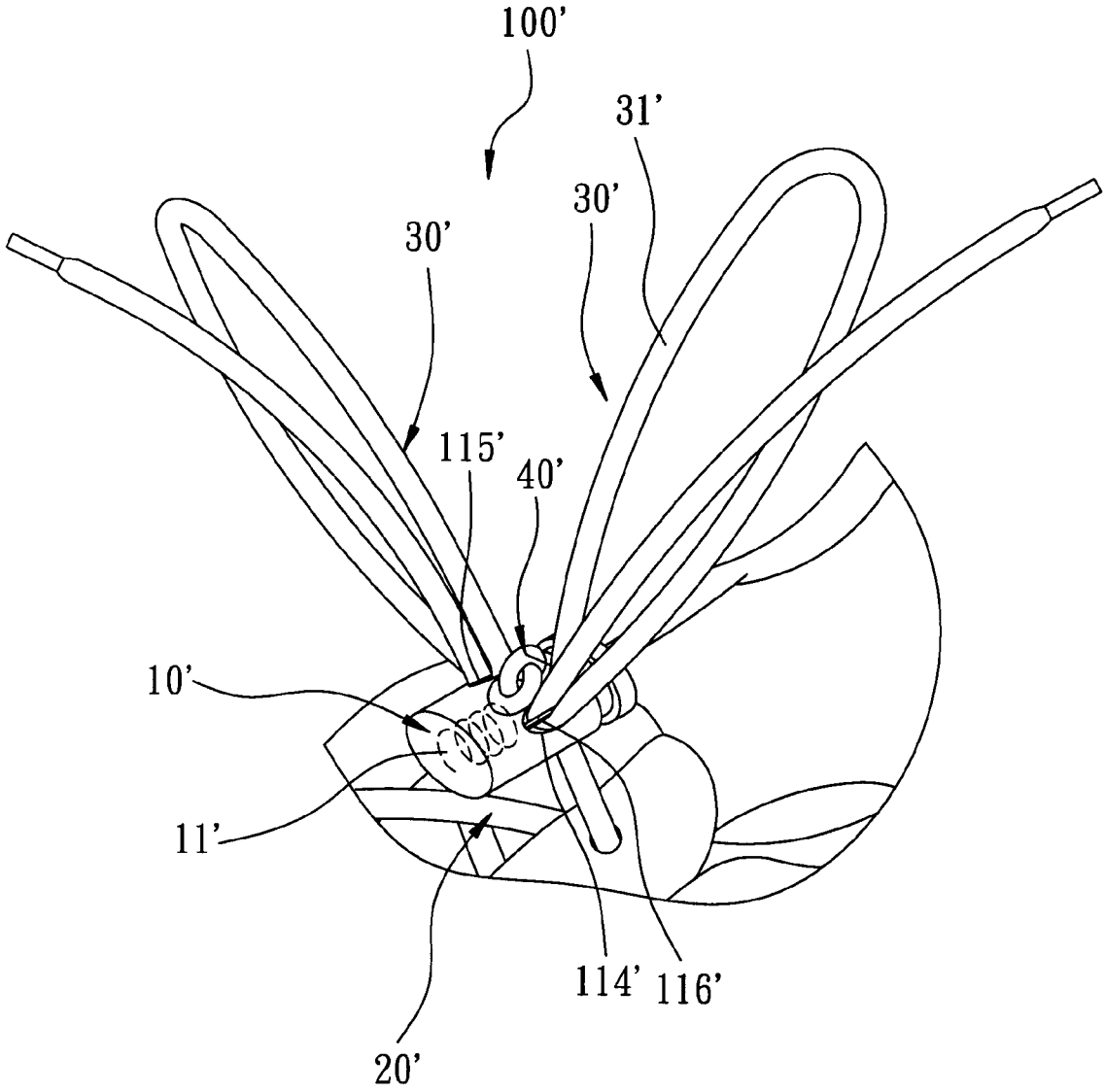
FIG. 9 is a fragmentary perspective view of a shoe that incorporates the second preferred embodiment of a double-bow shoe lace device according to the present invention.
Figure 10:
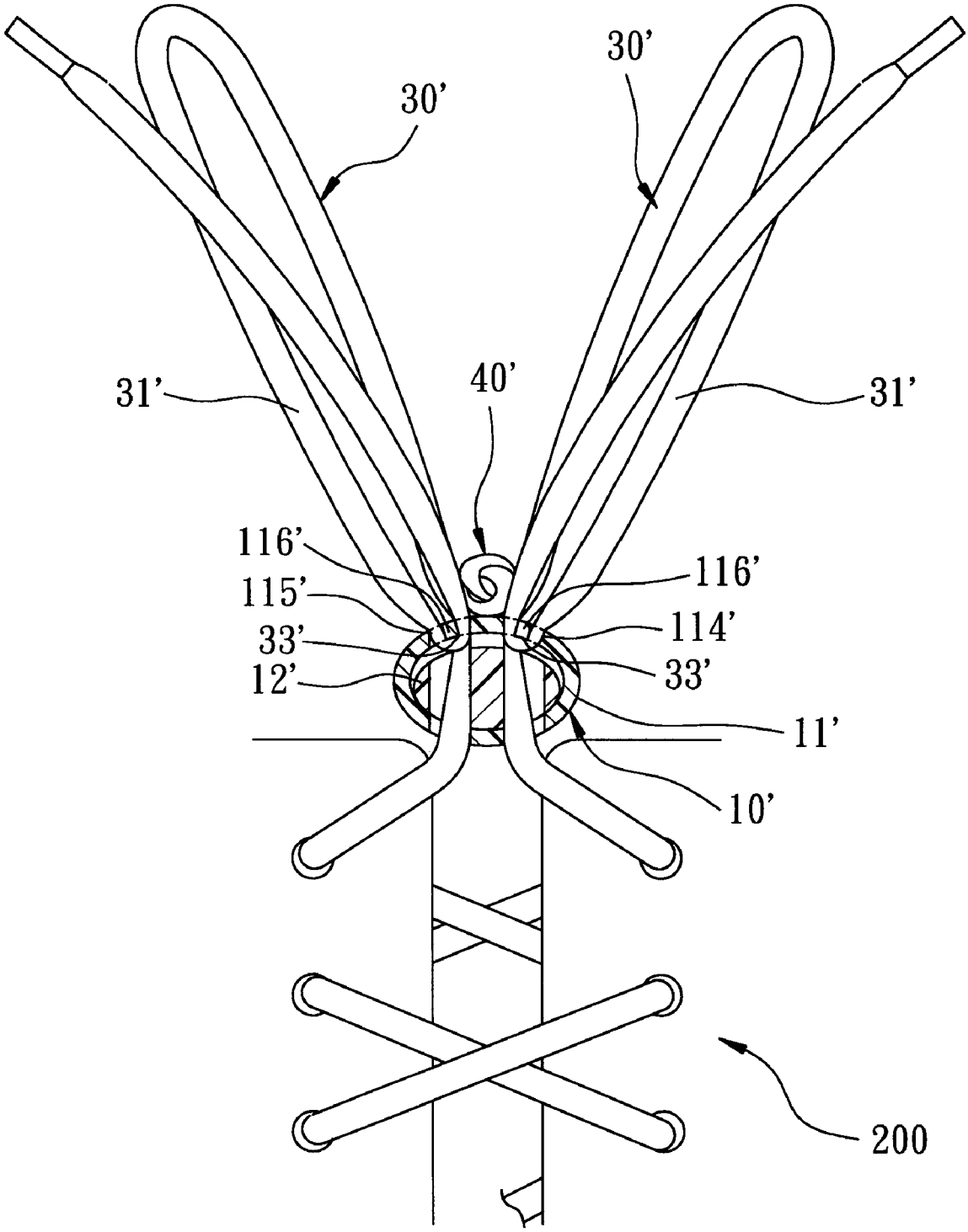
FIG. 10 illustrates how limiting rods of the second preferred embodiment extend respectively into inverted U-shaped lace segments of the loop assemblies to prevent removal of the clamp member from a shoe lace.

Referring to FIGS. 9 and 10, the second preferred embodiment of a shoe lace device 100' according to the present invention is shown to be substantially similar to the first preferred embodiment. However, unlike the first preferred embodiment, the casing 11' of the clamp member 10' has a pair of limiting rods 116', each of which is disposed in a respective one of the first and second loop holes 115', 114' and extends into the inverted U-shaped lace segment 31' of a respective one of the loop assemblies 30' to prevent removal of the clamp member 10' from the shoe lace 20'.

Figure 11:
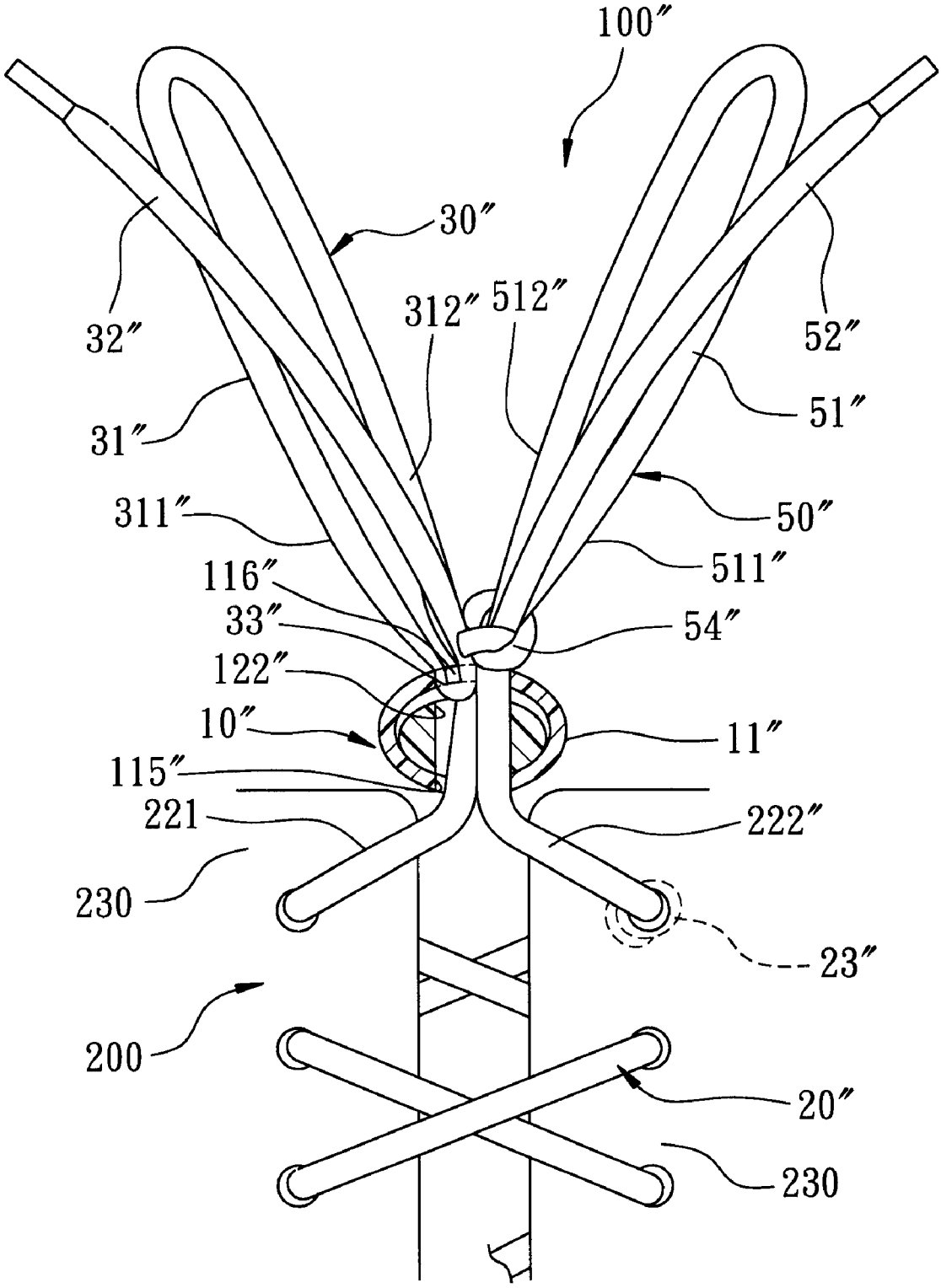
FIG. 11 is a fragmentary cross-sectional view illustrating a shoe that incorporates the third preferred embodiment of a double-bow shoe lace device according to the present invention.
Figure 12:
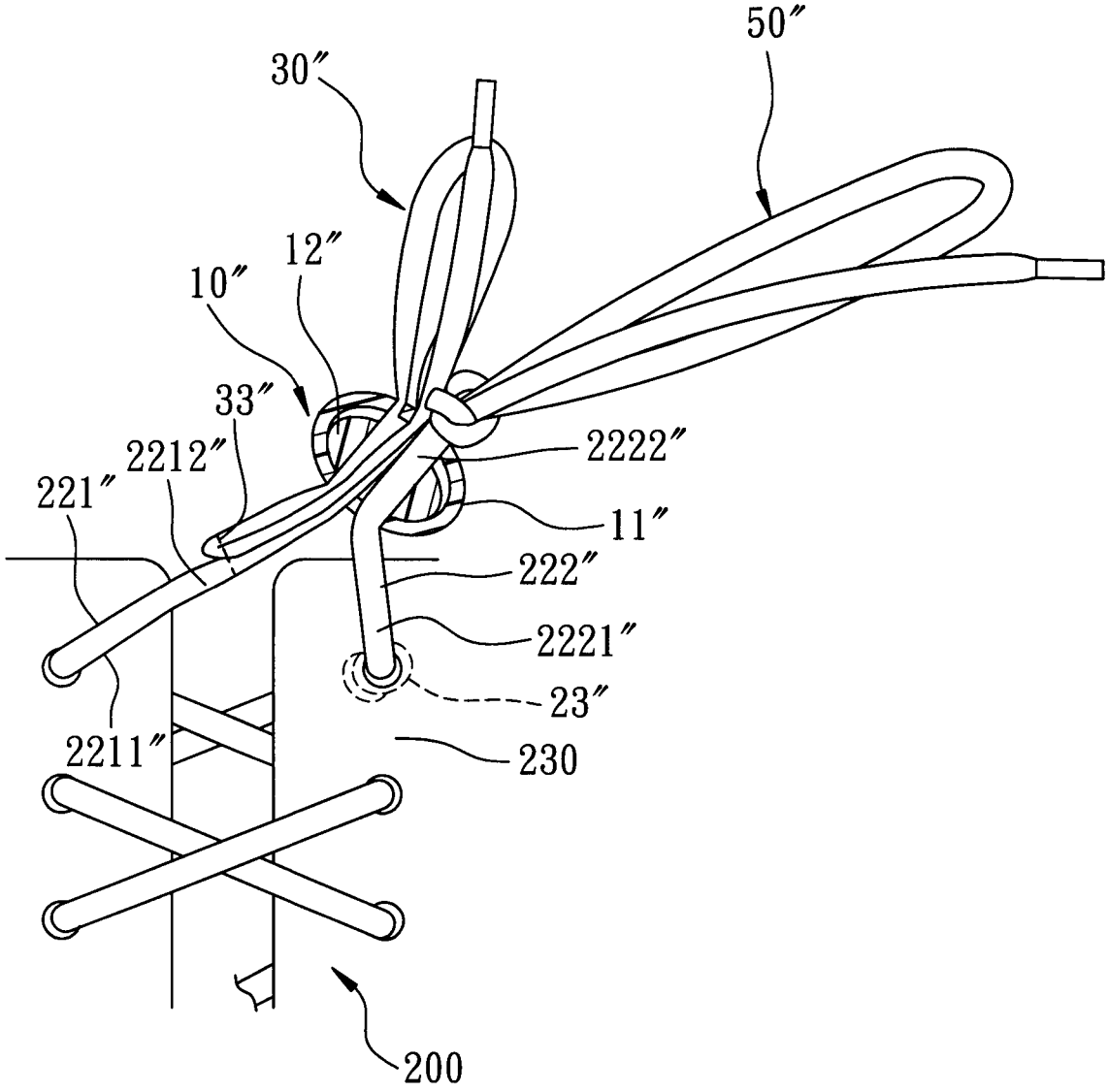
FIG. 12 is a fragmentary cross-sectional view illustrating how movement of the clamp member along a first loop assembly permits loosening of the shoe.

The third preferred embodiment of a shoe lace device 100" according to the present invention is shown in FIGS. 11 and 12. In this embodiment, the shoe lace 20" has a second lace segment that includes first and second lace sections 221", 222". Each of the first and second lace sections 221", 222" has a lower end 2211", 2221" connected to a first lace segment so as to be adapted to be anchored on a respective one of the eyelet tabs 230, and an upper end 2212", 2222". The first loop assembly 30" includes a first distal lace segment 32", a first inverted U-shaped lace segment 31"

having a first end 311" connected to the first distal lace segment 32", and a second end 312" connected to the upper end 2211" of the first lace section 221", and a fastening unit 33" for fastening together the first distal lace segment 32" and the first and second ends 311", 312" of the first inverted U-shaped lace segment 31".

Preferably, the lower end 2221" of the second lace section 222" is formed with a positioning knot 23" that is adapted to engage the respective one of the eyelet tabs 230. The second loop assembly 50" includes a second distal lace segment 52", a second inverted U-shaped lace segment 51" having first and second ends 511", 512", and a decorative knot 54" connected to the second distal lace segment 52", the first and second ends 511", 512" of the second inverted U-shaped lace segment 51", and the upper end 2222" of the second lace section 222. The decorative knot 54" is disposed on and externally of the clamp member 10" so as to prevent movement of the latter along the second loop assembly 50", and cooperates with the positioning knot 23" of the second lace section 222" to limit a maximum distance of the clamp member 10" from one of the eyelet tabs 230.

The clamp member 10" is sleeved slidably on the first loop assembly 30", permits the upper end 2222" of the second lace section 222" to extend therethrough, and includes an elongate casing 11", a clamping block 12", and a biasing member (not shown). The casing 11" has an open lateral side and a closed end portion opposite to the open lateral side, and is formed with a hole unit 115" that permits extension of the first loop assembly 30" and the upper end 2222" of the second lace section 222" therethrough. The casing 11" further has a limiting rod 116" disposed in the hole unit 115" and extending into the first inverted U-shaped lace segment 31" of the first loop assembly 30". The clamping block 12" is slidably received in the open lateral side of the casing 11", and is formed with a slot unit 122" that corresponds to the hole unit 115" in the casing 11" for extension of the first loop assembly 30" and the upper end 2222" of the second lace section 222" therethrough. The biasing member, in the form of a coil, is disposed in the closed end portion of the casing 11", and biases the clamping block 12" toward the open lateral side of the casing 11", thereby clamping the first loop assembly 30" and the upper end 2222" of the second lace section 222" between the clamping block 12" and the casing 11".

In use, when the first loop assembly 30" is pulled away from the second loop assembly 50", the clamp member 10 will be forced to slide downwardly along the first loop assembly 30", thereby bringing the lower ends 2211", 2221" of the lace sections 221", 222" closer together for tightening the shoe 200 (see FIG. 11). To loosen the shoe 200, the clamping block 12" is operated to compress the biasing member, thereby aligning the hole unit 115" with the slot unit 122". At this time, by moving the clamp member 10" upwardly along the first loop assembly 30", the lower ends 2211", 2221" of the lace sections 221", 222" can be moved away from each other, thereby loosening the shoe 200 (see FIG. 12).

Thus, the shoe 200, incorporating the double-bow shoe lace device 100, 100', 100" of the present invention, is not only easy to wear and remove, but also has an attractive appearance in view of the double-bow configuration of the shoe lace device 100, 100', 100". Furthermore, the shoe lace device 100, 100', 100" is simple since the clamp member 10 is sleeved on the loop assemblies 30, and is reliable due to the increased dimension at the fastening unit 33 that prevents removal of the loop assemblies 30 from the clamp member 10 in a non-compressed state of the clamp member 10.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1.A double-bow shoe lace device for a shoe with a pair of eyelet tabs, said shoe lace device comprising:

a shoe lace having first and second lace segments, said first lace segment being adapted to be strung on the shoe so as to form a criss-cross pattern on the eyelet tabs, said second lace segment including first and second lace sections, each of said first and second lace sections having a lower end connected to said first lace segment so as to be adapted to be anchored on a respective one of the eyelet tabs, each of said first and second lace sections further having an upper end;

a first loop assembly including a first distal lace segment, a first inverted U-shaped lace segment having a first end connected to said first distal lace segment, and a second end connected to said upper end of said first lace section, and a fastening unit for fastening together said first distal lace segment and said first and second ends of said first inverted U-shaped lace segment;

a second loop assembly including a second distal lace segment, a second inverted U-shaped lace segment having first and second ends, and a decorative knot connected to said second distal lace segment, said first and second ends of said second inverted U-shaped lace segment, and said upper end of said second lace section; and a clamp member sleeved slidably on said first loop assembly and permitting said upper end of said second lace section to extend therethrough, said clamp member including an elongate casing having an open lateral side and formed with a hole unit that permits extension of said first loop assembly and said upper end of said second lace section therethrough;

a clamping block slidably received in said casing and formed with a slot unit for extension of said first loop assembly and said upper end of said second lace section therethrough; and a biasing member disposed in said casing and biasing said clamping block toward said open lateral side of said casing, thereby clamping said first loop assembly and said upper end of said second lace section between said clamping block and said casing, downward movement of said clamp member along said first loop assembly bringing said lower ends of said first and second lace sections closer together for tightening the shoe, upward movement of said clamp member along said first loop assembly permitting said lower ends of said first and second lace sections to move away from each other for loosening the shoe.

2. The double-bow shoe lace device as claimed in claim 1, wherein said casing has a limiting rod disposed in said hole unit and extending into said first inverted U-shaped lace segment of said first loop assembly.

3. The double-bow shoe lace device as claimed in claim 1, wherein said lower end of said second lace section is formed with a knot that is adapted to engage the respective one of the eyelet tabs.

4. The double-bow shoe lace device as claimed in claim 1, wherein said decorative knot prevents movement of said clamp member along said second loop assembly.

5. A double-bow shoe lace device for a shoe with a pair of eyelet tabs, said shoe lace device comprising:

a shoe lace having first and second lace segments, said first lace segment being adapted to be strung on the shoe so as to form a criss-cross pattern on the eyelet tabs, said second lace segment including first and second lace sections, each of said first and second lace sections having a lower end connected to said first lace segment so as to be adapted to be anchored on a respective one of the eyelet tabs, each of said first and second lace sections further having an upper end;

two loop assemblies, each of which includes a distal lace segment, an inverted U-shaped lace segment having a first end connected to said distal lace segment, and a second end connected to said upper end of a respective one of said first and second lace sections, and a fastening unit for fastening together said distal lace segment and said first and second ends of said inverted U-shaped lace segment; and a clamp member sleeved slidably on said loop assemblies, and including an elongate casing having an open lateral side and formed with a hole unit that permits extension of said loop assemblies therethrough;

a clamping block slidably received in said casing and formed with a slot unit for extension of said loop assemblies therethough; and a biasing member disposed in said casing and biasing said clamping block toward said open lateral side of said casing, thereby clamping said loop assemblies between said clamping block and said casing, downward movement of said clamp member along said loop assemblies bringing said lower ends of said first and second lace portions closer together for tightening the shoe, upward movement of said clamp member along said loop assemblies permitting said lower ends of said first and second lace portions to move away from each other for loosening the shoe.

6. The double-bow shoe lace device as claimed in claim 5, wherein said hole unit includes first and second loop holes that permit said loop assemblies to extend respectively therethrough, said slot unit including first and second loop slots that permit said loop assemblies to extend respectively therethrough.

7. The double-bow shoe lace device as claimed in claim 6, wherein said casing has a pair of limiting rods, each of which is disposed in a respective one of said first and second loop holes and extends into said inverted U-shaped lace segment of a respective one of said loop assemblies to prevent removal of said clamp member from said shoe lace.

8. The double-bow shoe lace device as claimed in claim 5, further comprising a decorative knot mounted on said clamp member and disposed between said loop assemblies.

* * * * *